US006763964B1

(12) United States Patent
Hurlbut et al.

(10) Patent No.: US 6,763,964 B1
(45) Date of Patent: Jul. 20, 2004

(54) ONE HAND OPENABLE LID FOR BEVERAGE CONTAINER

(75) Inventors: Gary A. Hurlbut, Seattle, WA (US); Tami L. Fujii, Bellevue, WA (US); Sara E. Hill, Seattle, WA (US); B. Cameron Smith, Seattle, WA (US); Scott C. Thielman, Seattle, WA (US)

(73) Assignee: Pacific Market, Inc., Seattle, WA (US)

( * ) Notice: Subject to any disclaimer, the term of this patent is extended or adjusted under 35 U.S.C. 154(b) by 0 days.

(21) Appl. No.: 10/170,167

(22) Filed: Jun. 11, 2002

(51) Int. Cl.[7] ..... A47G 19/22; B65D 51/16; B65D 51/18

(52) U.S. Cl. ..... 220/254.3; 220/254.2; 220/714; 220/715; 220/367.1; 222/481.5; 222/483; 222/484; 222/456

(58) Field of Search ..... 220/254.2, 254.3, 220/714, 715, 836, 845, 367.1; 222/481.5, 482, 483, 484, 556

(56) References Cited

U.S. PATENT DOCUMENTS

| | | | | | |
|---|---|---|---|---|---|
| 2,447,870 | A | * | 8/1948 | Polcyn | 220/715 |
| 3,964,631 | A | | 6/1976 | Albert | 220/90.4 |
| 3,967,748 | A | | 7/1976 | Albert | 220/90.4 |
| 3,972,443 | A | * | 8/1976 | Albert | 220/715 |
| 4,099,642 | A | | 7/1978 | Nergard | 220/90.4 |
| 4,133,446 | A | | 1/1979 | Albert | 220/90.4 |
| 4,136,799 | A | * | 1/1979 | Albert | 220/298 |
| 4,190,173 | A | | 2/1980 | Mason et al. | 220/203 |
| 4,212,408 | A | * | 7/1980 | Valenzona | 220/254.5 |
| 4,303,173 | A | | 12/1981 | Nergard | 220/254 |
| 4,712,704 | A | * | 12/1987 | Ramsey et al. | 220/254.4 |
| 5,085,336 | A | * | 2/1992 | Lynd | 220/708 |
| 5,222,623 | A | * | 6/1993 | Eger et al. | 220/715 |
| 5,249,703 | A | | 10/1993 | Karp | 220/719 |
| 5,462,189 | A | * | 10/1995 | Pierce | 220/815 |
| 5,477,980 | A | * | 12/1995 | Chaffin | 220/715 |
| 5,485,938 | A | * | 1/1996 | Boersma | 220/714 |
| 5,680,951 | A | | 10/1997 | Feltman, III et al. | 220/253 |
| 6,010,029 | A | | 1/2000 | Wang | 220/714 |
| 6,098,834 | A | * | 8/2000 | Hatsumoto et al. | 220/715 |

* cited by examiner

*Primary Examiner*—Stephen K. Cronin
*Assistant Examiner*—James Smalley
(74) *Attorney, Agent, or Firm*—Michael J. Folise, Esq.

(57) ABSTRACT

A leak proof lid for a beverage container has a rocker arm which may be moved between open and closed positions by one hand. The lid is provided with drinking and venting apertures and respective basins within the lid. The rocker arm includes venting and drinking seals for sealing the respective aperture when the rocker arm is in the closed position. The rocker arm is easily removable from an upper side of the lid to facilitate cleaning the venting and drinking aperture and seals on the rocker arm.

20 Claims, 2 Drawing Sheets

ONE HAND OPENABLE LID FOR BEVERAGE CONTAINER

TECHNICAL FIELD

The invention relates to removable lids for beverage containers. More specifically, the invention relates to selectively openable push button lids for insulated beverage containers.

BACKGROUND OF THE INVENTION

Thermally insulated beverage containers have become increasingly popular with the public for use with hot beverages, such as coffee. Containers of this type may also be used for cold beverages as well. Hot beverages, such as coffee and tea, impose the most demanding thermal requirements on such a container. As a result, consumers have come to appreciate that double-walled, vacuum-insulated containers perform this function best. Such containers have sidewalls often manufactured from metal, particular stainless steel, to withstand the high mechanical loading due to atmospheric pressure. Thermally insulated beverage containers designed for keeping cold beverages from becoming warm typically place a lower thermal load on the beverage container. As a result, such containers are often manufactured with a plastic double wall, wherein the interstitial space between the inner and outer walls is either thermally insulated with air or a foamed material.

In either case, it is highly desirable to provide a selectively openable lid for the beverage container. The lid performs at least two functions, the first of which is to prevent the beverage from spilling out of the container when the user is not actually drinking the beverage. This feature is particularly important when a hot beverage is in the container so as to prevent the user from becoming burned if the container tips over. As a second function, the lid should provide for drinking the fluid at a constant rate to prevent splashing or dribbling when the beverage is being drunk from the container. The lids for such containers are therefore typically provided with an open position, a closed position, and a third position in which the entire lid can be removed from the beverage container for cleaning.

Lids of this type generally fall into either the rotatable twist type lid, or the push button type lid. An example of a travel mug having a three-position, rotatable lid of the type described above is disclosed in U.S. Pat. No. 5,249,703 to Karp. That patent discloses a travel mug having two inwardly directly circumferential ears defining a gap region therebetween. A rotatable lid, having radially directed arms emanating from a central region at the bottom of the lid which adapted to pass through the gaps in the ears, and when rotated with the lid engage an underside of the circumferential rim of the lid with the radially inwardly directed ears. The rim is provided with diametrically opposed apertures to permit fluid to egress from the mug while air enters in through the remaining aperture to equalize pressure within the mug. The disclosure of this patent is incorporated herein by reference. One particular problem with this prior art design is that the drinking vessel must be specially manufactured with dedicated structure to engage the arms of the lid. In addition, although the lid is substantially splashproof when the lid is in the closed position, it is not leakproof if the mug is tipped over. Variations of the rotatable lid design are shown in U.S. Pat. No. 5,680,951 to Feltman, et al., and U.S. Pat. No. 4,190,173 to Mason, et al. These designs employ a two piece rotating structure with seals therebetween. These designs are therefore substantially more spill and leak proof than the device disclosed by Karp. Nevertheless, the two pieces are not easily separable resulting in the interstitial zones being difficult or impossible to maintain in a hygienic condition. Furthermore, almost all of the rotatable designs are difficult to operate with one hand, a serious disadvantage when using mugs having the lid and driving a car or truck.

It has become increasingly common for users to employ thermally insulated beverage containers, particularly of the type best adapted for insulating hot beverages such as coffee, in moving vehicles, such as automobiles. One design branch in the prior art has attempted to overcome the above-noted deficiencies of the twist type lid by providing a lid for such containers which is easily operated by a single hand between an open and closed position so that the user does not inadvertently spill a hot beverage on herself while driving her car. Lids of this type often employ a push bottom mechanism having a normally closed position. Examples of such prior art devices are shown in the following patents: U.S. Pat. No. 4,303,173 to Nergard; U.S. Pat. No. 3,964,631 to Albert; U.S. Pat. No. 3,967,748 to Albert; and U.S. Pat. No. 4,099,642 to Nergard. With respect to the lids disclosed in the above-identified patents, the user typically depresses a button near the rim of the lid to remove a stopper-like device from an aperture in the lid. Releasing the button returns the stopper to its normally closed position. Although devices of this type perform their intended function well, they have a significant unanticipated drawback. Specifically, the position of a stopper in a normally closed position provides an ideal breeding ground for bacteria in the junction between the stopper and the lid drinking aperture. In order to properly clean a lid of this type which quickly becomes fouled with such bacterial growth, the user must manually clean the lid by holding the mechanism open while using a brush or the like. It has been found that merely placing such lids in a dishwasher or the like will not adequately clean the area of contact between the stopper and the lid. Most users of this type of device find the requirement to manually wash the lid so inconvenient that they frequently will not purchase a second product of the same design. Furthermore, while push button lids discussed above are substantially spill proof due to the urging of the stopper like device against a value seat (typically by spring pressure), such designs are far from leak proof when used in a book bag or backpack environment.

Therefore a need exists for a splashproof and leakproof lid for an insulated beverage container which provides a truly leakproof and spillproof design in both an open and closed position, which does not encourage bacterial growth between moveable parts of the lid, which is easily cleaned by the user and which can be operated with a single hand.

SUMMARY OF THE INVENTION

It is therefore an object of the present invention to provide a removable lid for an insulated beverage container having leakproof and spillproof open and closed positions.

It is yet another object of the invention to achieve the above-described object with a removable lid which does not encourage bacterial growth between moving parts of the lid.

It is yet another object of the present invention to achieve the above objects in a removable lid which is easy to clean.

The invention achieves these objects, and other objects and advantages which will become apparent from the description which follows, by providing a selectively openable lid for a drinking vessel having a main body or base member and a rocker arm pivotally connected to an upper side of the base member. The base member has drinking and venting apertures or bores. The rocker arm carries corresponding flexible fluid seals for receipt in their respective bores such that the rocker arm is pivotable between a first, closed position and a second, open position. The fluid seals in the preferred embodiment have resilient laterally extending flanges or fingers having dimensions slightly larger than the bores to provide substantial fluid and air conduits through the respective venting and drinking bores in the base member when the rocker arm is in the second, open position, and to seal the bores in the base member when the rocker arm is in the first, closed position.

The rocker arm is preferably provided with resilient arms which are engaged with corresponding detents on the main body or base member so that the rocker arm and base member are disengagable and so that they may be cleaned by immersion in a dishwasher or the like without the need for an individual to physically maintain the members in a separate condition against spring pressure or the like.

The rocker arm and main body or base member can be provided with substantially any external geometric appearance, however a circular appearance is preferred to coincide with the substantially circular cross-sectional dimension of most beverage containers. In addition, the drinking end of the rocker arm is preferably curved and the main body is preferably provided with a depressed region surrounding the drinking aperture bore so as to form a drinking basin for the user.

DETAILED DESCRIPTION OF THE PREFERRED EMBODIMENTS

Figure 1:
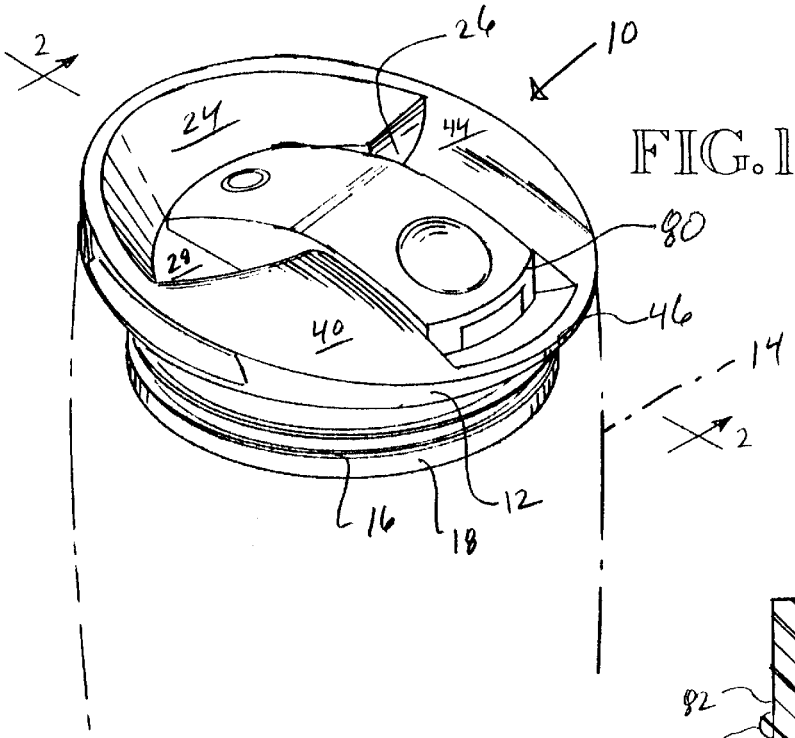
FIG. 1 is an isometric, perspective view of the selectively openable lid of the present invention in use with a generic drinking vessel.

A beverage container lid, in accordance with the principles of the invention, is generally indicated at reference numeral 10 in FIG. 1. The lid has a substantially circular base member or main body 12 which is adapted for closing an open end of a conventional beverage container 14, shown in phantom lines in FIG. 1. The beverage container may be of the tumbler type (that is without a handle) for use in automotive beverage receptacles, or transport in backpacks, book bags and the like (not shown). The main body 12 is fluidly connected to the beverage container 14 by any conventional means such as threads 16 on a lower, downwardly depending portion 18 including a flexible rubber "O" ring seal 20. The particular means for mating the lid 10 to the container 14 is a matter of choice for one of ordinary skill in this art. Thus, although thread 16 and "O" ring 20 have been shown as the preferred method, those of ordinary skill in the art will appreciate that a bayonet style mount, or any other positive means for sealing the lid 12 with respect to the beverage container 14 may be substituted.

The main body 12 has a curved upper surface having a raised semi-circular lip 24 terminating in an arcuate rear wall 26 and a downwardly sloped floor region 28 defining a depressed drinking basin 30 for the receipt of a beverage, such as coffee, from the beverage container 14 when the entire assembly is tipped towards a user's lips. Fluid communication between the drinking basin 30 and interior of the beverage container is provided by way of a circular drinking bore 32. The drinking bore has a diameter of approximately 2 centimeters and a downwardly depending, smooth side wall 34 having a depth of approximately 5 millimeters.

The main body 12 also has two raised shoulder areas 40, 44, which extend rearwardly from the arcuate rear wall 26 to a rear lip 46 at an elevation lower than that with respect to the raised semi-circular lip 24. The shoulder areas 40, 44 define a wedge-shaped receptacle, generally indicated at reference numeral 52, having a substantially planar floor 54 which is rearwardly sloped away from the floor region 28. A substantially vertical septum 58 divides the floor region 28 from the planar floor 54.

The rearwardly sloped, planar floor supports a circular venting bore 60 having an upper opening 62 and a lower opening 64. The venting bore 60 has a substantially cylindrical upper portion having smooth side walls 66 having a diameter of approximately 8 millimeters and a lower portion 68 having an enlarged diameter also with smooth side walls. The upper and lower sections are connected by a conically tapered transition section 70. It should be noted that the upper portion having the smooth side wall 66 is located above the smooth side wall 34 of the drinking bore 32.

Figure 2:
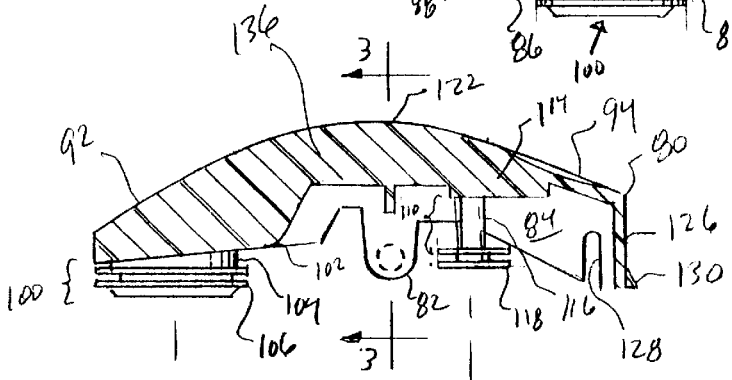
FIG. 2 is an exploded, cross-sectional, side elevational view of the base member or main body and rocker arm of the lid.
Figure 2:
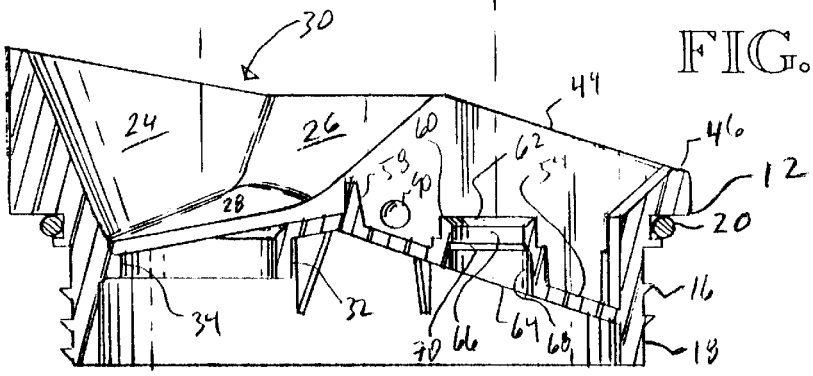

As shown in FIGS. 1 and 2, the lid includes a rocker arm 80 which is pivotally connected to the main body 12 by a pair of flexible arms 82 centrally located on side walls 84 of the rocker arm. Distal ends 86 of the flexible arms 82 support laterally extending pips 88 for receipt in detents 90 on the main body 12. In this manner, the rocker arm 80 is pivotal between an open position shown in FIG. 1, and a closed position to be described further herein below. The rocker arm has a drinking end 92 and an opposed venting end 94. The drinking end supports a drinking seal assembly generally indicated at reference numeral 100 consisting of a main block 102 and a downwardly depending stem 104 supporting a pair of laterally extending drinking seal flanges 106. In this preferred embodiment, both the drinking bore 32 and a perimeter of the drinking seal flanges 106 are substantially circular, and the diameter of the drinking seal flanges slightly exceeds the diameter of the drinking seal bore. Thus, as will be described in further detail below, the drinking seal flanges 106 can seal the drinking seal bore 102.

The rocker arm 80 also has adjacent to its venting end 94 a venting seal assembly generally indicated at reference numeral 110. The venting seal assembly includes a main block 114 connected to a downwardly depending, elongated stem 116 terminating in a pair of laterally extending venting seal flanges 118. In this preferred embodiment, the venting bore 60 and the venting seal flanges 188 are substantially circular wherein the venting seal flanges have a diameter slightly larger than that of the venting bore 60 so that the venting seals flanges can seal the venting bore in a manner to be further described herein below.

The rocker arm 80 has an upper surface which is downwardly curved towards both the drinking end 92 and the venting end 94 from a central apex region 122. In this manner, the drinking end 92 is positioned substantially below the raised semi-circular lip 24 when the rocker arm 80 is in the open position as shown in FIG. 1 so as to avoid interference with a user's nose when drinking from the lid 10/beverage container 14 combination. Similarly, when the rocker arm 80 is in the closed position, the portion of the rocker arm between the vertex 22 and the venting end 94 maintains a substantially planar relationship with shoulder areas 40, 44 so as to provide a substantially smooth surface without protuberances which might become caught against items in a book bag or the like when the lid 10/drinking vessel 14 combination is stored therein. The rocker arm 80 is also provided with a rear wall 126 which is made flexible by means of cut out portions 128 in the sidewalls 84 adjacent to the rear wall 126. Each lower corner of the rear wall 26 is provided with ramp like protrusions 130 which frictionally engage an interior rear wall 134 of the wedge shaped receptacle 52 to maintain the rocker arm 80 in the open position shown in FIG. 1.

The lid 10, and rocker arm 80 are preferably manufactured by the injection molding process utilizing a food grade thermoplastic material such as acrylonitrile butadiene styrene (ABS). The drinking seal assembly 100 and venting seal assembly 110 are preferably sequentially molded into the rocker arm 80 and are preferably manufactured from a food grade silicone rubber. The venting seal assembly and drinking seal assembly can be molded during the same injection step by providing a runner 136 there between a matter well understood by those of ordinary skill in the relevant art.

Figure 3:
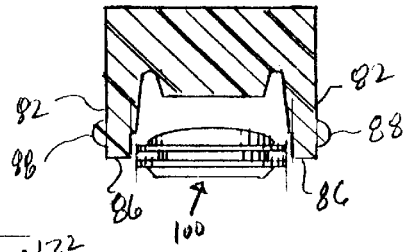
FIG. 3 is a rear elevational view of the rocker arm.

As stated above, in the preferred embodiment of the invention shown in FIGS. 1 through 3, the drinking seal flanges 106 and the venting seal flanges 118 have a diameter slightly larger than the diameters of the respective bores 34, 66 into which they are received when the rocker arm is in the closed position. It is an advantage of the present invention that the frictional engagement of the flanges with the interior side walls 34, 66 maintains the rocker arm 80 in the closed position. The degree of frictional engagement is determined by the degree to which the diameter of the flanges exceeds the interior diameter of the interior walls 34, 66 and also the thickness of the flanges themselves. In the preferred embodiment shown in the figures, the flanges have a lateral extension from their respective stems of approximately 1 millimeter and a thickness of approximately 0.5 millimeter. The outer diameter of the flanges exceeds the diameter of the inner walls 34, 66 by approximately 0.5 millimeter. It has been found that this structural orientation provides sufficient resistence to opening and sufficient sealing effect to prevent leakage when the rocker arm is in the closed position. Nevertheless, there is insufficient resistence to prevent the rocker arm from being moved to the open position with the use of a single hand by depressing on the rocker arm venting end 94.

Figure 4:
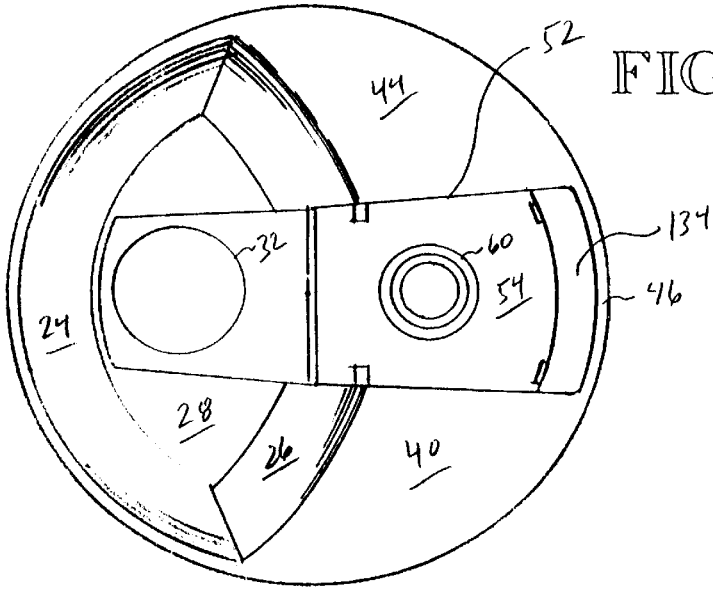
FIG. 4 is a top plan view of the lid in an open position.
Figure 5:
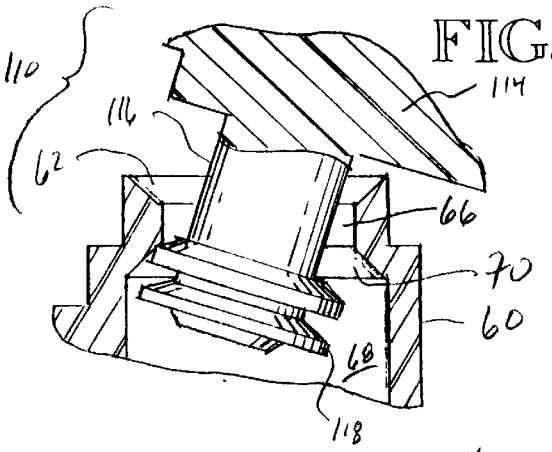
FIG. 5 is an enlarged, sectional view of the rocker arm venting bore in the open position.
Figure 6:
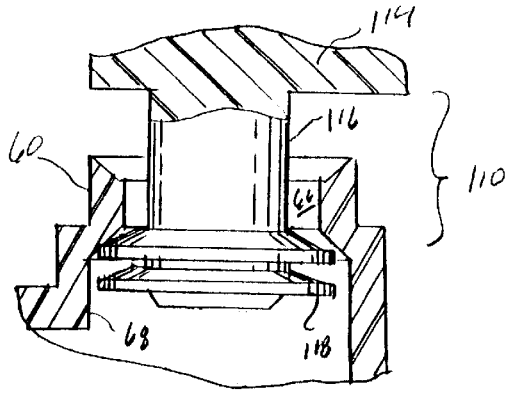
FIG. 6 is a view similar to FIG. 5 showing the rocker arm approaching a closed position.
Figure 7:
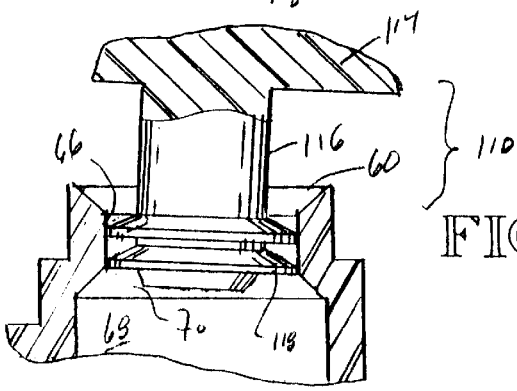
FIG. 7 is a view similar to FIG. 5 with the rocker arm in the closed position illustrating deformation of the venting seal flanges.

The sealing action described above is best understood with reference to FIGS. 4 through 6 in which the inner action of the venting seal assembly 110 and the venting bore 60 is illustrated. FIG. 4 illustrates the relative positions of those elements when the rocker arm 80 is in the open position. As best seen in FIG. 5, when the rocker arm is intermediate the open and closed positions, and is moving towards the closed position, the venting seal assembly 110 begins to move upwardly with respect to the venting bore 60 and venting seal flanges 118 begin to contact the transition zone 70 so as to deform the flanges 118 into a slightly conical shape. Upon fully seating the rocker arm 80 in the closed position, the venting seal assembly 110 and the venting bore 60 assume the relative position shown in FIG. 6 wherein the venting seal flanges 118 are substantially deformed into a cone like shape. As will be understood by those of ordinary skill in the art, the same mechanical relationship accrues with respect to the sidewall 34 of the drinking bore 32 and the drinking seal flanges 106. Nevertheless, when the flanges 106, 118 are in the deformed conical orientation, the sealing effectiveness of each assembly is substantially improved so as to provide a leak-proof seal. In addition, any over pressure within the beverage container 14 such as due to agitation, or partial vacuum formed therein due to a hot beverage becoming cool will necessarily have to react against the conically deformed valves flanges to unseat them, so as to further ensure a leak proof lid.

Other variations and embodiments of the invention are contemplated which will be apparent to those of ordinary skill in the art upon reviewing this disclosure. Therefore, the invention is not to be limited by the above disclosure, but is to be determined in scope by the claims that follow.

We claim:

1. A selectively openable drinking vessel lid adapted for receipt on the drinking vessel in an operating orientation and for operation with one hand, comprising:

a substantially circular main body having an upper side, a lower side and wherein the main body defines a depressed drinking basin on the upper side and diametrically opposed drinking and venting bores having substantially smooth sidewalls;

an elongated rocker arm, vertically removable and pivotally connected to the upper side of the main body and having drinking and venting ends, the rocker arm being pivotable with respect to the main body between an open and a closed position;

a drinking seal connected to the rocker arm adjacent to the drinking end, the drinking seal having a resilient, laterally extending, circumferential flange having a perimeter larger than a perimeter of the drinking bore for forming a seal with the side wall thereof; and, a venting seal connected to the rocker arm adjacent to the venting end, the venting seal having a resilient, laterally extending circumferential flange having a perimeter larger than a perimeter of the venting bore for forming a seal with the side wall thereof, so that the drinking and venting seal flanges are above and below their respective bores when the rocker arm is in the open position and so that the drinking and venting seal flanges are within the bores when the rocker arm is in the closed position.

2. The selectively openable lid of claim 1, including means for connecting the main body to a drinking vessel, wherein the rocker arm is substantially curved so that the drinking seal resides in a plane substantially lower than does the venting seal such that the drinking end of the rocker arm when in the open position does not mechanically interfere with a user's nose when the lid is used in connection with the drinking vessel.

3. The selectively openable lid of claim 1, wherein the elongated rocker arm is vertically removable from the main body by means of a pair of centrally positioned, flexible arms having detent pips at ends thereof and wherein the main body has centrally disposed detents external to the drinking basin for receipt of the pips.

4. The selectively openable lid of claim 1, wherein the main body has a raised, substantially planar surface adjacent to and substantially surrounding the venting bore, and wherein the rocker arm has a substantially planar upper surface adjacent to the venting end so that outside of the drinking basin, the main body and the venting end of the rocker arm present a substantially flat, coextensive profile without protuberances when the rocker arm is in the closed position.

5. The selectively openable lid of claim 1, wherein the lid has means for maintaining the rocker arm in the open position.

6. The selectively openable lid of claim 5, wherein the flanges and the bores are circular.

7. The selectively openable lid of claim 6, wherein the flanges are sufficiently resilient to deform into conic sections when the flanges are received in their respective bores.

8. A selectively openable drinking vessel lid adapted for receipt on the drinking vessel in an operating orientation and for operation with one hand, comprising:

a main body having an upper side, a lower side and opposed drinking and venting bores having substantially smooth sidewalls;

a removable, elongated rocker arm pivotally connected to the upper side of the main body between the drinking and venting bores and having drinking and venting ends, the rocker arm being pivotable with respect to the main body between an open and a closed position;

a drinking seal connected to the rocker arm adjacent to the drinking end, the drinking seal having a resilient, laterally extending, circumferential flange having a perimeter larger than a perimeter of the drinking bore for forming a friction fit seal with the side wall thereof; and, a venting seal connected to the rocker arm adjacent to the venting end, the venting seal having a resilient, laterally extending circumferential flange having a perimeter larger than a perimeter of the venting bore for forming a friction fit seal with the side wall thereof, whereby the flanges are out of registration with their respective bores when the rocker arm is in the open position and so that the flanges are received within the bores when the rocker arm is in the closed position.

9. The selectively openable lid of claim 8, including means for fluidly connecting the main body to a drinking vessel, wherein the rocker arm is substantially curved so that the drinking seal resides in a plane substantially lower than does the venting seal such that the drinking end of the rocker arm when in the open position does not mechanically interfere with a user's nose when the lid is used in connection with the drinking vessel.

10. The selectively openable lid of claim 8, wherein the lid has removal means for vertically removing the rocker arm from the main body to facilitate cleaning the bores and the seals.

11. The selectively openable lid of claim 8, wherein the removal means includes a pair of centrally positioned, flexible arms on the rocker arm, each flexible arm having an outwardly directed detent pip at an end thereof and wherein the main body has centrally disposed detents for receipt of the pips.

12. The selectively openable lid of claim 8, wherein the main body has a raised, substantially planar surface adjacent to and substantially surrounding the venting bore, and wherein the rocker arm has a substantially planar upper surface adjacent to the venting end so that the lid in the vicinity of the venting end presents a substantially flat profile without protuberances when the rocker arm is in the closed position.

13. The selectively openable lid of claim 8, wherein the flanges are connected to the rocker arm by resilient stems.

14. The selectively openable lid of claim 8, wherein the flanges and the bores are circular.

15. The selectively openable lid of claim 14, wherein the flanges are sufficiently resilient to deform into conic sections when the flanges are received in their respective bores.

16. The selectively openable lid of claim 8, wherein the main body is substantially circular and the bores are diametrically opposed.

17. The selectively openable lid of claim 8, wherein the main body defines a depressed drinking region, and wherein the drinking bore is located within the drinking region and the venting bore is located outside of the drinking region.

18. A selectively openable drinking vessel lid adapted for receipt on a drinking vessel, in an operating orientation operation with one hand, comprising:

a main body having an upper side, a lower side and opposed drinking and venting bores having substantially smooth sidewalls;

a removable, elongated rocker arm pivotally connected to the upper side of the main body and having drinking and venting ends, the rocker arm being pivotable with respect to the main body between an open and a closed position;

a drinking seal having a resilient, laterally extending, circumferential drinking seal flange for forming a friction fit seal with the drinking bore side wall, the drinking seal flange being connected to the rocker arm so as to be located above the drinking bore when the rocker arm is in the open position; and, a venting seal having a resilient, laterally extending, circumferential venting seal flange for forming a friction fit seal with the venting bore side wall, the venting seal flange being connected to the rocker arm so as to be located below the venting bore when the rocker arm is in the open position.

19. The selectively openable lid of claim 18, wherein the lid has removal means for removing the rocker arm from the main body to facilitate cleaning the bores and the seals.

20. The selectively openable lid of claim 18, wherein the flanges and the bores are circular and wherein the venting flange is sufficiently resilient to deform into a conic section when the flange is received in the venting bore.

* * * * *